US007410064B2

(12) United States Patent
Kato et al.

(10) Patent No.: US 7,410,064 B2
(45) Date of Patent: Aug. 12, 2008

(54) CIRCULAR-CYLINDER SIEVE

(75) Inventors: Fumio Kato, Handa (JP); Yoshio Sakakibara, Handa (JP); Hidenori Yamaguchi, Handa (JP)

(73) Assignee: Tsukasa Industry Co., Ltd., Handa-Shi, Aichi (JP)

( * ) Notice: Subject to any disclaimer, the term of this patent is extended or adjusted under 35 U.S.C. 154(b) by 401 days.

(21) Appl. No.: 10/540,885

(22) PCT Filed: Dec. 24, 2003

(86) PCT No.: PCT/JP03/16520

§ 371 (c)(1),
(2), (4) Date: Jun. 27, 2005

(87) PCT Pub. No.: WO2004/060584

PCT Pub. Date: Jul. 22, 2004

(65) Prior Publication Data

US 2006/0102527 A1 May 18, 2006

(30) Foreign Application Priority Data

Dec. 27, 2002 (JP) ..... 2002-382612

(51) Int. Cl.
*B07B 1/20* (2006.01)

(52) U.S. Cl. ..... 209/406; 209/300; 209/305; 209/410

(58) Field of Classification Search ..... 209/300, 209/305, 406, 407, 410, 411; 210/413–415
See application file for complete search history.

(56) References Cited

U.S. PATENT DOCUMENTS

| | | | | | |
|---|---|---|---|---|---|
| 1,717,604 | A * | 6/1929 | Haug et al. | ..... | 210/394 |
| 2,055,119 | A * | 9/1936 | Clendening | ..... | 209/407 |
| 4,178,246 | A * | 12/1979 | Klein | ..... | 210/787 |
| 5,697,503 | A * | 12/1997 | Serres | ..... | 209/407 |
| 6,338,412 | B1 * | 1/2002 | Serres et al. | ..... | 210/415 |

FOREIGN PATENT DOCUMENTS

| | | |
|---|---|---|
| JP | 57-12278 | 6/1955 |
| JP | 60-95986 | 6/1985 |

(Continued)

*Primary Examiner*—Joseph C Rodriguez
(74) *Attorney, Agent, or Firm*—Antonelli, Terry, Stout & Kraus, LLP.

(57) ABSTRACT

In a cylindrical sieve, a first frame 7 is provided with a first ring plate 7*a* arranged in a radial direction and a ring plate 7*b* extended inward in an axial direction X of the sieve from an inner end of the first ring plate 7*a*. The ring plate 7*b* has an inwardly warped end. A ring projection 2*a* is fit in a ring-shaped cavity K1 defined by a ring recess 10*a* and the first frame 7. The ring plate 7*b* presses the ring projection 2*a* outward in the radial direction to prevent the ring projection 2*a* from being slipped off the matching recess. Through holes 7*c* (counter bores) are formed in the first frame 7 along the axial direction X. Four of the through holes 7*c* are used to fasten the rods 6 and receive the Phillips head screws 6*f* seated therein, and the remaining through holes 7*c* receives Phillips head screws 20 (see FIG. 1) seated therein for reinforced linkage of the first frame 7 with the holder frame 11.

10 Claims, 14 Drawing Sheets

FOREIGN PATENT DOCUMENTS

| | | |
|---|---|---|
| JP | 63-69577 | 3/1988 |
| JP | 3-131372 | 6/1991 |
| JP | 6-303 | 1/1994 |
| JP | 6-321335 | 11/1994 |
| JP | 11-244784 | 9/1999 |
| WO | WO 02/38290 A1 | 5/2002 |

* cited by examiner

CIRCULAR-CYLINDER SIEVE

TECHNICAL FIELD

The present invention relates to a cylindrical sieve used in a cylindrical sieve-type particulate sifter for removal of foreign substances and for removal and crush of particulate lumps and aggregates.

BACKGROUND ART

Contamination of food with foreign substances and food poisoning are some of major social problems. The term HACCP has recently become familiar to even general consumers. The principal of HACCP is total management for safety and health in (food) manufacturing processes. The comprehensive countermeasures including designs of plants, manufacturing equipment and devices, and delivery are required for the total management. There is a manufacturing standard called GMP (Good Manufacturing Practice) for improvement in manufacturing environments and health to effectively prevent contamination of the manufacturing environments with offending substances. Compliance with the GMP standard to achieve the goals of the HACCP plans has been highly demanded. The GMP standard mainly focuses safety management of employees and plants and process management, but also has a requirement that machines and equipment are to be 'designed adequately for cleaning'. In food industries, there are various measures to ensure safety handling of particulate materials and prevent contamination with foreign substances in particulate supply equipment.

The foreign substances as potential contamination of the particulate products include metal pieces, glass pieces, gravels, plastic pieces, hairs, wood pieces, paper pieces, little pieces of thread, and rubber pieces. These foreign substances may be mixed both in a material supply process as those present in a row material and in a manufacturing step. These foreign materials may be mixed also in a manufacturing step.

Various particulate supply systems are used in food plants according to their scales, ranging, for example, from manual feed into blenders and other processing devices in small plants, to auto bag-opening and to auto measurement and auto particulate supplies from silos in big plants. There are accordingly diverse process steps in the food plants, for example, a stock process, a measurement process, an auto bag-opening process, a manual feed process, a pneumatic conveying process, a foreign substance removal process, and a dust elimination process. The manual feed process has a high potential for contamination with foreign substances in the manufacturing area required to have strict cleanness. Such facilities are to be improved promptly also from the viewpoint of the workers' safety.

In the pneumatic conveying system, zoning is allowed between a particulate supply area and a food production area. A sifter or magnets located between the two areas can be used to remove foreign substances or insect pests mixed in particulate materials. Additionally, one batch of the particulate material can be kept for the next process and thus the working efficiency can be improved by using a dumping server (manual-feed pneumatic conveying device) or a pneumatic conveying receiver also as a storage bin.

There are possibilities of 'exterior contamination with foreign substances' and 'interior generation of foreign substances' in the devices of the respective process steps, and various countermeasures have been proposed.

In order to prevent 'exterior contamination with foreign substances', the whole line should be designed to be fullautomatic and fully closed. If this is not practical, strict zoning tactics should be adopted to prevent contamination with foreign substances.

It is often assumed that the particulates are dry and are thus not suitable for propagation of microorganisms even if the particulates are food. Under certain conditions, however, dew condensation may occur in the line (especially in the stock step) to cause propagation of microorganisms and trigger 'interior generation of foreign substances'. The aggregates and lumps of particulates may breed insect pest. The possible countermeasures against this problem are 'thorough cleaning of parts with a high potential for adhesion of particulates to make a dead stock', 'adequate design and selection of devices with little potential for adhesion and accumulation of particulates', and 'minimized dew condensation due to a temperature difference in devices'.

Cylindrical sifters are generally used to prevent contamination with foreign substances and to remove and crush aggregates and lumps of particulates. The cylindrical sifters include inline sifters (see, for example, WO 02/38290A1 and Japanese Patent Laid-Open Gazette No. H-6-321335) and non-inline sifters (see, for example, Japanese Patent Laid-Open Gazette No. H-3-131372, No. H-11-244784, No. S-63-69577, No. H-6-303, and No. S-57-12278). Recently developed have been high-performance sifters that have blades on a shaft rotating at a high speed in a cylindrical sieve for forcible sieving.

Diverse cylindrical sieves have been developed to be adopted in such cylindrical sifters.

[Patent Document 1] Japanese Utility Model Laid-Open Gazette No. S-60-95986.

This invention provides a sieve mounting structure adopted in a cylindrical sifter 1. A mounting frame 2, to which sieves 3 and 21 are mounted, is formed in a substantially cylindrical shape and includes two circular end frames 5 located on both ends in a bus direction S and a linkage frame 7 extended in the bus direction S for linkage of the two end frames 5. The sieves 3 and 21 have lock elements 9 and 22 provided on both ends thereof in the bus direction S. A large number of through holes 10 and 28 are made between the lock elements 9 and 22. The lock elements 9 and 22 of the sieves 3 and 21 are attached to the end frames 5 by means of fixing elements 4 and 23. The sieves 3 and 21 are strained in the bus direction S inside the mounting frame 2. The mounting frame 2 also includes intermediate frames 6 and 25 that are located between the end frames 5 and are joined with the end frames 5 via the linkage frame 7. The lock elements 9 and 22 of the sieves 3 and 21 are mounted on the intermediate frames 6 and 25 via the fixing elements 4 and 23. The intermediate frames 6 and 25 have a smaller diameter than the diameter of the end frames 5 and are gradually tapered. Rubber cushions 14 are interposed between the sieves 3 and 21 and the intermediate frames 6 and 25.

In this prior art structure, the sieves 3 and 21 are attached with tension to the end frames 5 of the mounting frame 2 by means of the fixing elements 4 and 23 having screws, washers, and nuts. This structure lessens the number of attachments and facilitates the mounting operation. The most areas of the sieves 3 and 21 except the areas close to the lock elements 9 and 22 and the seams exert the sieving function and have practically smooth surface. This ensures the smooth flow of object particulates to be processed without causing localized abrasion. Tension of the strained attachment prevents slacks and thus prevents clogging of the sieves having even low rigidity, making the processed particulates flow smoothly.

The prior art structure disclosed in Patent Document 1, however, still has some drawbacks as discussed below:

(1) The sieves 3 and 21 are fastened to the end frames 5 of the mounting frame 2 by the fixing elements 4 and 23 and are strained through adjustment of the screws. It is practically impossible to set the perfectly even clamping force of the fixing elements over the cylindrical faces of the sieves. There is naturally a variation in tension over the faces of the sieves 3 and 21. The varying tension may cause slacks of the sieves 3 and 21. For example, the areas close to the screws may be tightly strained, while the residual areas may be rather loose. The local clamping of the sieves 3 and 21 with the fixing elements may deform the sieves 3 and 21 to have wavy edges. Namely only skilled workers can successfully strain the sieves to set relatively even tensions over the sieves, whereas unskilled workers may have a failure and time-consuming post-adjustment may be required).

There are high-performance cylindrical inline sifters that have blades on a shaft rotating at a high speed in the sieve for forcible sieving. The slacks of the sieves 3 and 21 may cause the rotating blades to come into contact with and damage the sieves 3 and 21.

(2) Attachment and detachment of the screws of the fixing elements 4 and 23 are rather time-consuming and make replacement of the sieves 3 and 21 troublesome. Fixation of the sieves 3 and 21 having the larger diameter by the fixing elements 4 and 23 is often beyond one worker's control.

By taking into account the drawbacks of the prior art structure discussed above, the cylindrical sieve of the invention aims to enable even an unskilled worker to easily equalize the tension over the sieve by simple operations without causing any slack and to enable only one worker to easily replace even a large net member.

DISCLOSURE OF THE INVENTION

The present invention is directed to a cylindrical sieve, which includes: a cylindrical net member that has ring projections provided on both ends thereof; multiple bar members of a preset length that are extended in an axial direction; a first ring member that is provided with first lock elements fixed to or fit in respective one ends of the bar members; a second ring member that is provided with second lock elements fixed to or fit in respective other ends of the bar members; and a pair of holder ring members that are located between the first ring member and the second ring member to be movable along the multiple bar members and have ring recesses. The ring projections are set in the ring recesses, and the holder ring members are respectively brought into contact with the first ring member and with the second ring member. The first lock elements and the second lock elements work to prevent the ring projections from being slipped off the ring recesses. The holder ring members are respectively fastened to the first ring member and to the second ring member by means of fixation elements.

The cylindrical sieve disclosed in claim 1 desirably eliminates the drawbacks of the prior art structure.

In the cylindrical sieve of the invention, the multiple bar members have the fixed length, and the cylindrical net member is clamped between the adjoining ring members by means of the ring projections provided on both ends of the net member. This structure enables even an unskilled worker to evenly apply the tension over the net member and accordingly prevents any potential slack of the net member due to a local difference in tension.

The ring projections of the net member are fastened by the first ring member, the second ring member, and the holder ring members. This structure enables only one worker to easily replace even a large net member.

The net member may be made of any of diverse materials including synthetic resins and metals. Available materials of the net member include meshes (for example, polyester meshes, nylon meshes, and standard steel (SS) or stainless steel (SUS) meshes), punching metals with a large number of apertures perforated therein, and integrally molded synthetic resins with a large number of openings. The aperture ratio is set in a generally acceptable range but is preferably not less than 40%. Each of the ring projections may be formed, for example, to have a circular cross section or a rectangular cross section or to be hollow.

The frame structure except the net member is preferably designed to forbid disassembly. The varying intervals between the adjoining frames for fastening the net member may undesirably cause a variation in tension over the net member.

It is preferable that the net member is divided into multiple pieces.

That is, the present invention is also directed to a cylindrical sieve, which includes: a cylindrical first net member that has ring projections provided on both ends thereof; a cylindrical second net member that has ring projections provided on both ends thereof; multiple bar members of a preset length that are extended in an axial direction; a first ring member that is fixed to or fit in respective one ends of the bar members; a second ring member that is fixed to or fit in respective other ends of the bar members; an intermediate ring member that is fixed to middle sections of the bar members; a pair of first holder ring members that are located between the first ring member and the intermediate ring member to be movable along the multiple bar members and have ring recesses; and a pair of second holder ring members that are located between the intermediate ring member and the second ring member to be movable along the multiple bar members and have ring recesses. The ring projections of the first net member are set in the ring recesses of the first holder ring members, and the first holder ring members are respectively brought into contact with the first ring member and with the intermediate ring member. The first holder ring members are respectively fastened to the first ring member and to the intermediate ring member by means of fixation elements. The ring projections of the second net member are set in the ring recesses of the second holder ring members, and the second holder ring members are respectively brought into contact with the intermediate ring member and with the second ring member. The second holder ring members are respectively fastened to the intermediate ring member and to the second ring member by means of fixation elements.

In one preferable embodiment, each of the first ring member, the second ring member, and the intermediate ring member has a first ring plate arranged in a radial direction and a second ring plate extended in the axial direction from the first ring plate. Each of the ring projections is set in a ring-shaped cavity defined by the ring recess, the first ring plate, and the second ring plate. The second ring plate holds down the ring projection inward in the radial direction and accordingly prevents the ring projection from being slipped off the ring-shaped cavity.

In another preferable embodiment, the fixation elements are nuts, which are screwed and set on male screws formed on the bar members to be relatively movable in the axial direction.

In still another preferable embodiment, the ring projections have circular or rectangular cross sections in the axial direction and are made of a material having a sufficient hardness to hold their circular or rectangular shapes when being fit in the ring recesses.

The ring projections made of the material having the sufficient hardness to hold their original shapes facilitate fixation to the frame structure of the sieve.

In one preferable arrangement, the net member is surrounded by the multiple bar members, the first ring member, the second ring member, and the holder ring members.

BEST MODES OF CARRYING OUT THE INVENTION

Figure 1:
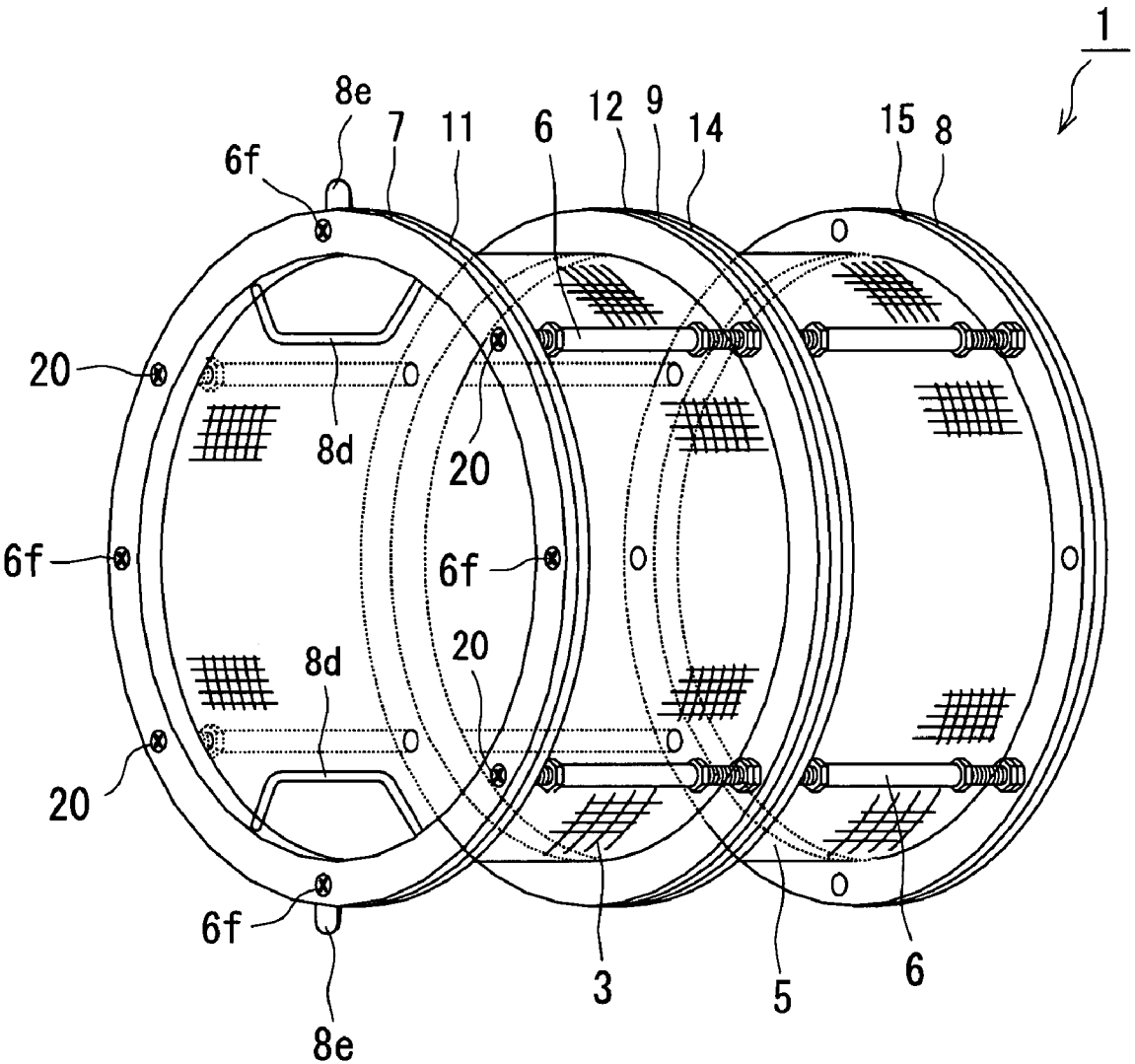
FIG. 1 is a perspective view showing a cylindrical sieve in a first embodiment of the invention.
Figure 2:
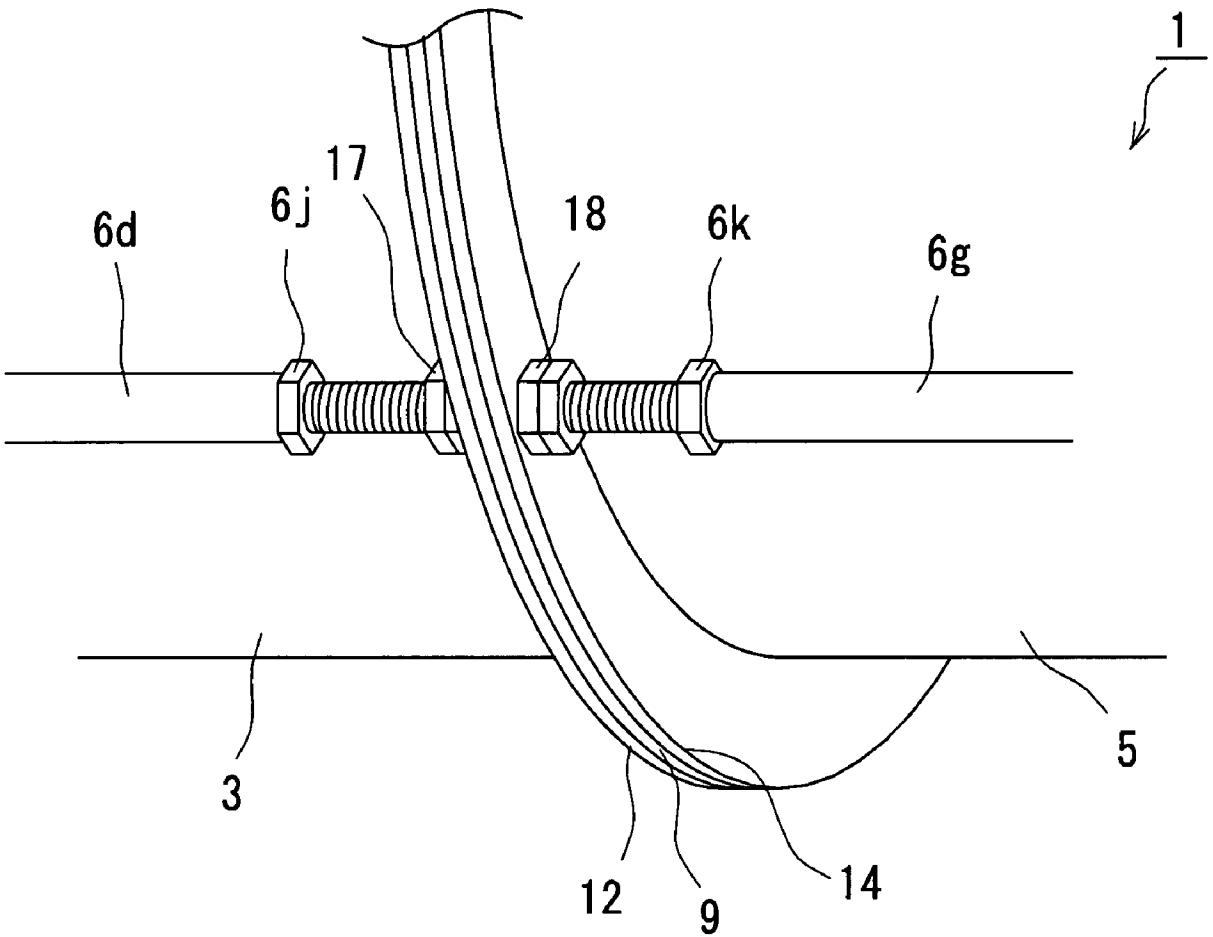
FIG. 2 is a partially enlarged perspective view showing an intermediate frame of the cylindrical sieve.

A cylindrical sieve 1 in one embodiment of the invention is discussed below with reference to FIGS. 1 through 7. The cylindrical sieve 1 includes a cylindrical first net member 3 with a pair of ring projections 2*a* and 2*b* formed on both ends thereof, a cylindrical second net member 5 with a pair of ring projections 4*a* and 4*b* formed on both ends thereof, multiple (four in this embodiment) rods 6 of a fixed length extended in an axial direction X, a circular ring-shaped first frame 7 fixed to a face perpendicular to the axial direction X on respective one end sections 6*a* of the rods 6, a circular ring-shaped second frame 8 fixed to a face perpendicular to the axial direction X on respective other end sections 6*b* of the rods 6, and a circular ring-shaped intermediate frame 9 fixed to a face perpendicular to the axial direction X on middle sections 6*c* of the rods 6. The cylindrical sieve 1 further includes a pair of circular ring-shaped first holder frames 11 and 12 that are positioned between the first frame 7 and the intermediate frame 9 to be movable along the rods 6, have ring recesses 10*a* and 10*b* formed by methods such as ditching, and are arranged on faces perpendicular to the axial direction X to be movable and fixable in the axial direction X, and a pair of circular ring-shaped second holder frames 14 and 15 that are positioned between the intermediate frame 9 and the second frame 8 to be movable along the rods 6, have ring recesses 13*a* and 13*b*, and are arranged on faces perpendicular to the axial direction X to be movable and fixable in the axial direction X.

The ring projections 2*a* and 2*b* of the first net member 3 are fit in the ring recesses 10*a* and 10*b* of the first holder frames 11 and 12. The first holder frames 11 and 12 are respectively brought into contact with and fastened to the first frame 7 and to the intermediate frame 9 by means of fixation elements 16 and 17 (for example, nuts). The interval between the first frame 7 and the second frame 8, the interval between the first frame 7 and the intermediate frame 9, and the interval between the intermediate frame 9 and the second frame 8 are respectively set to fixed lengths.

The ring projections 4*a* and 4*b* of the second net member 5 are fit in the ring recesses 13*a* and 13*b* of the second holder frames 14 and 15. The second frames holder frames 14 and 15 are respectively brought into contact with the intermediate frame 9 and the second frame 8, and the second holder frames 14 and 15 are respectively fastened to the intermediate frame 9 and the second frame 8 by means of fixation elements 18 and 19.

The cylindrical sieve 1 is preferably made of stainless steel, although the first net member 3 and the second net member 5 may be composed of synthetic resin, instead of stainless steel. The total dimensions of the cylindrical sieve 1 are unchanged, regardless of attachment and detachment of the first and second net members 3 and 5.

The respective elements of the cylindrical sieve 1 are described in detail.

Figure 3A:
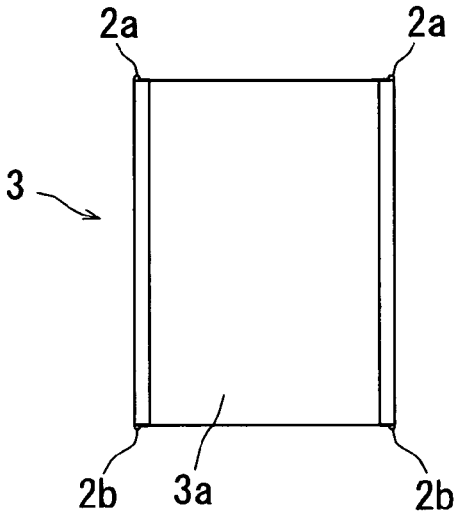
FIG. 3A is a front view of a first net member.
Figure 3C:
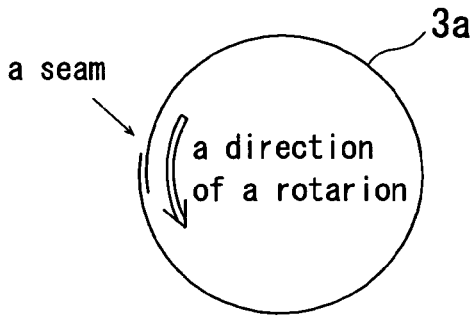
FIG. 3C is a side view showing a main net body of the first net member.
Figure 3B:
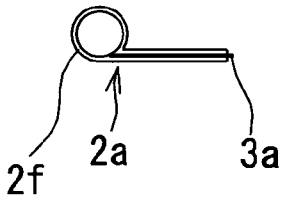
FIG. 3B is a sectional view of an end portion of the first net member.

The first net member 3 is formed to have a cylindrical shape as shown in FIGS. 3A through 3C. The first net member 3 may be made of any material having sufficient flexibility and plasticity, such as synthetic resin (for example, polyester) and may be obtained by netting or by integral molding. The dimensions of the first net member 3 may be determined arbitrarily according to the applications.

The first net member 3 has a main net body 3*a* with the ring projections 2*a* and 2*b* attached to the outer circumference of both ends thereof.

The material of the main net body 3*a* of the first net member 3 is not restricted at all, and the form of the main body 3*a* may be a mesh or a punching plate. The aperture ratio of the first net member 3 may be selected arbitrarily according to the requirements, but is preferably in a range of 40 to 66%. One preferable example of the main net body 3*a* is made of polyethylene terephthalate (PET) and has a mesh of 30.5, an opening of 0.6, a wire diameter of 0.245, and an aperture ratio of 51%.

As shown in FIG. 3B, the ring projections 2*a* and 2*b* are frames made of synthetic resin (for example, vinylon). A doubled joint band element 2*f* is extended from each of the opening of the circular section of 2*a* and 2*b*. And each end of the main net body 3*a* is clamped between the doubled joint band and sewed therebetween. Each of the ring projections 2*a* and 2*b* has a frame having circular cross section along the axial direction X and a sufficient hardness to hold the circular shape when being fit in the matching recess as discussed later. The ring projections 2*a* and 2*b* may be hollow or may alternatively have ring-shaped core reinforcements.

FIG. 3C shows the main net body 3*a*. The main net body 3*a* is designed to have a seam in an inverse direction to a rotating direction of blades set in a cylindrical sifter (not shown). The rotating direction of the blades is reversed corresponding to the orientation of a particulate inlet.

The second net member 5 has the identical structure with that of the first net member 3. The above description and illustration regarding the first net member 3 is thus also applied to the second net member 5.

Similarly the ring projections 4*a* and 4*b* are identical with the ring projections 2*a* and 2*b*, so that the above description and illustration regarding the ring projections 2*a* and 2*b* is also applied to the ring projections 4*a* and 4*b*.

Figure 3D:
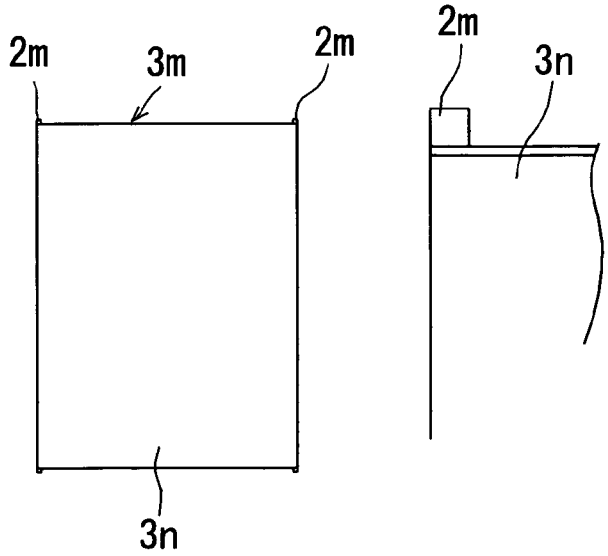
FIG. 3D is a front view showing a net member made of a hard material.

FIG. 3D shows a cylindrical net member 3*m* made of a flexible hard material, such as metal mesh or punching metal. Rectangular or circular rings 2*m* are fixed to specific areas of an outer circumference on both ends of a main net body 3*n*. The aperture ratio of the first net member 3 may be selected arbitrarily according to the requirements, but is preferably in a range of 44 to 55%. One preferable example of the cylindrical net member 3*m* is made of stainless steel and has a mesh of 16, an opening of 1.09, a wire diameter of 0.5, and an aperture ratio of 47.1%.

Figure 4:
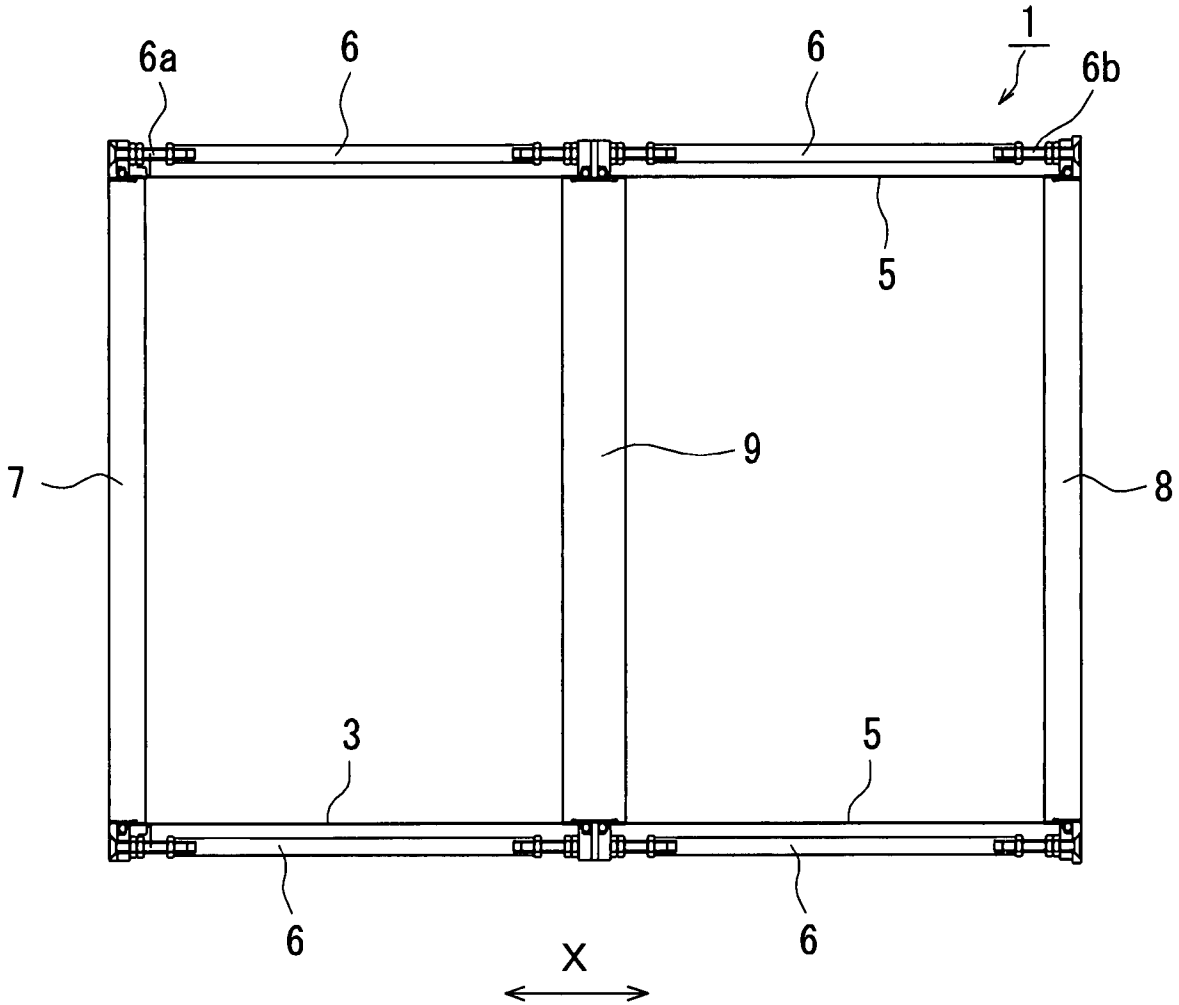
FIG. 4 is a center-vertical sectional view of the cylindrical sieve.

As shown in FIG. 4, the first net member 3 is surrounded by the rods 6, the first frame 7, the second frame 8, the first holder frames 11 and 12, and the second holder frames 14 and 15. The respective frames 7, 8, 11, 12, 14, and 15 are arranged coaxially and preferably have substantially identical inner diameters and outer diameters.

Figure 5:
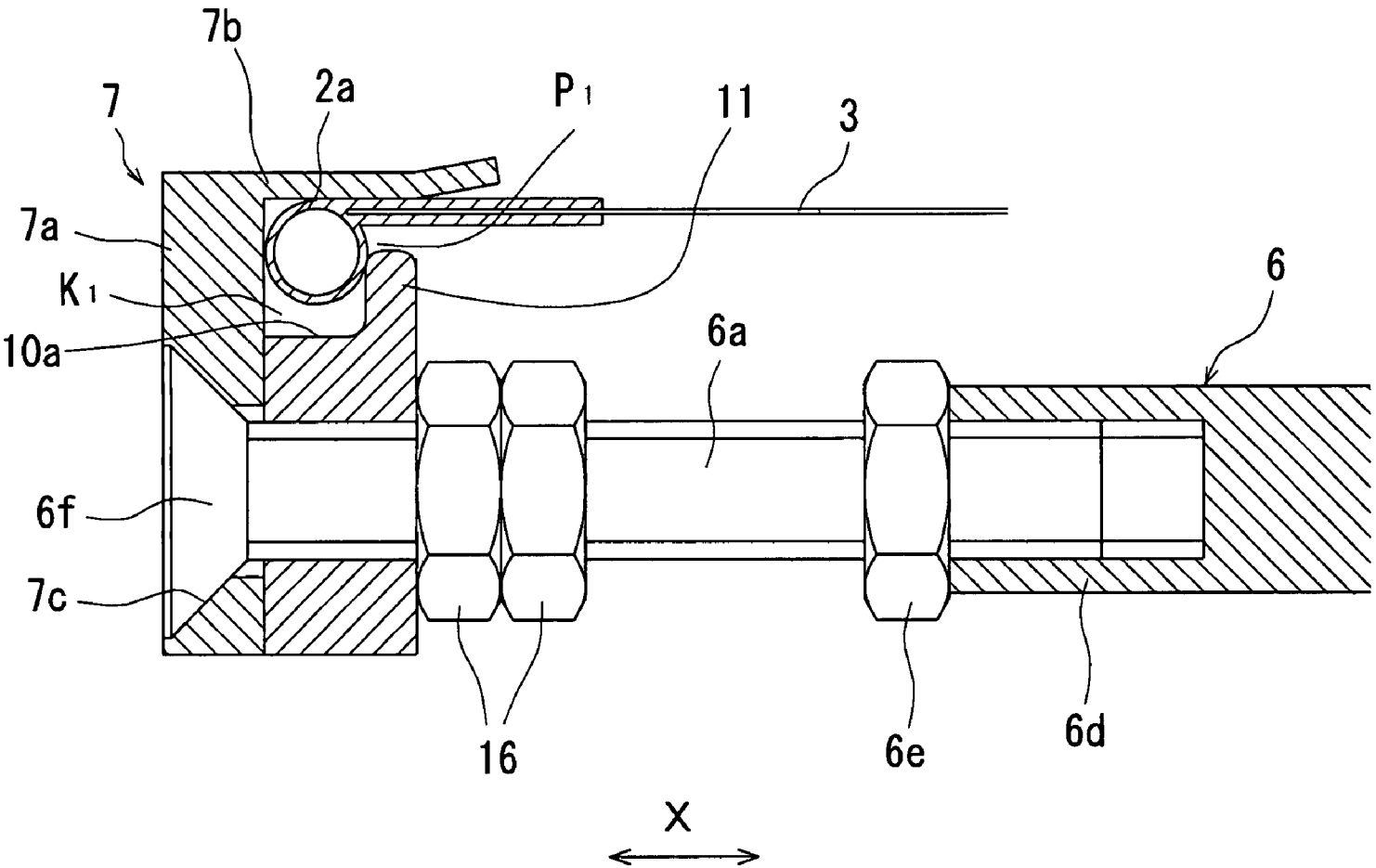
FIG. 5 is an end-vertical sectional front view showing a first frame of the cylindrical sieve.

Referring to FIG. 5, the one end section 6*a* of each rod 6 has a base screwed into a rod element 6*d* and fastened and welded to the rod element 6*d* via a nut 6*e* and a head forming a Phillips head screw 6*f*. Similarly the other end section 6*b* of each rod 6 has a base screwed into a rod element 6g and fastened and welded to the rod element 6*g* via a nut 6*h* and a head forming a Phillips head screw 6*i*.

Both ends of the middle section 6*c* are screwed into the rod elements 6*d* and 6*g* and are fastened and welded to the rod elements 6*d* and 6*g* via nuts 6*j* and 6*k*.

Figure 8C:
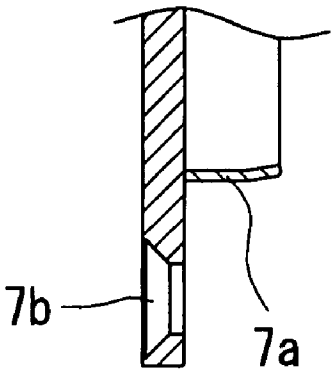
FIG. 8C is an end-sectional front view of the first frame.
Figure 8B:
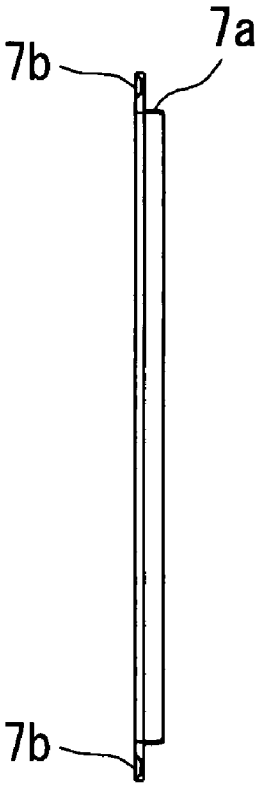
FIG. 8B is a front view of the first frame.
Figure 8A:
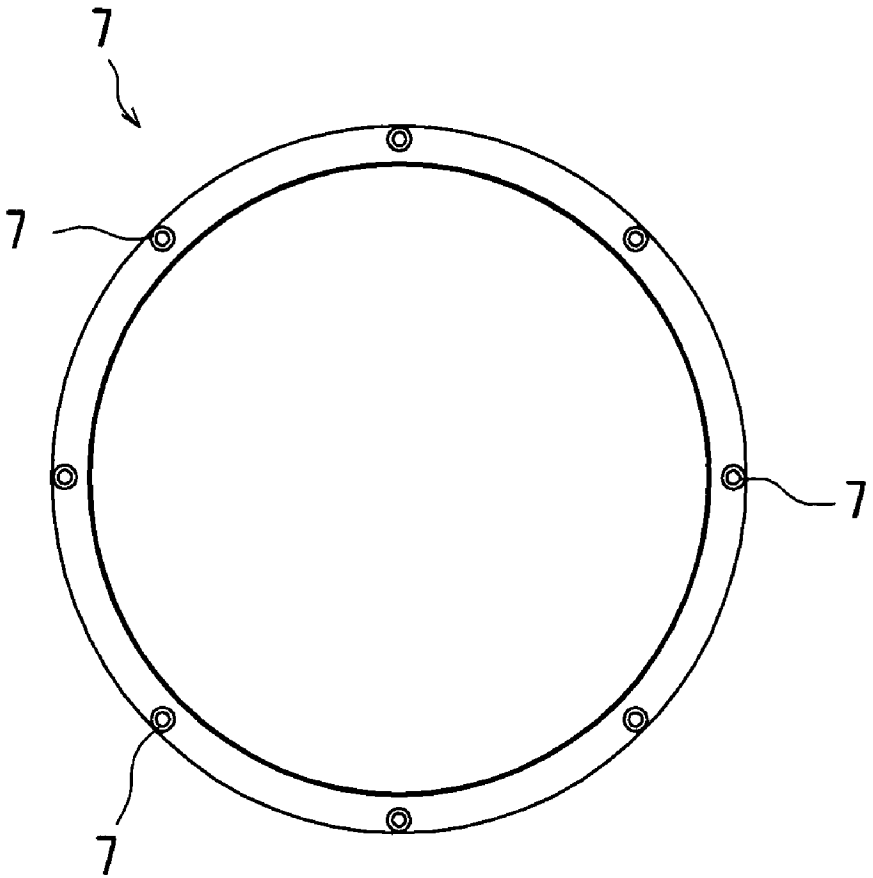
FIG. 8A is a left side view of the first frame.
Figure 9C:
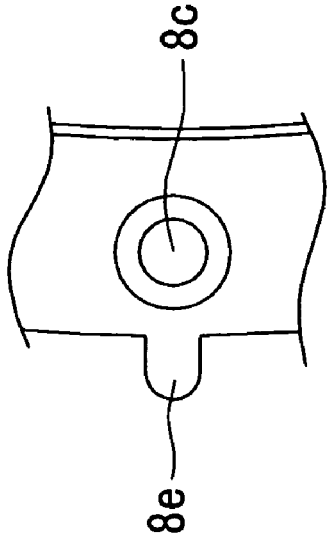
FIG. 9C is an enlarged view showing a circumferential part of FIG. 9A.
Figure 9D:
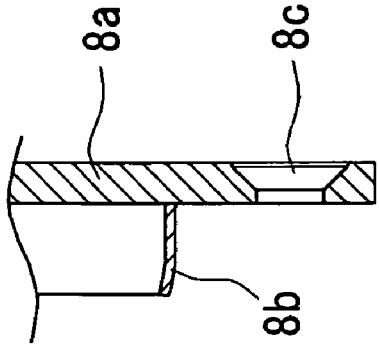
FIG. 9D is an end-sectional front view of the second frame.
Figure 9B:
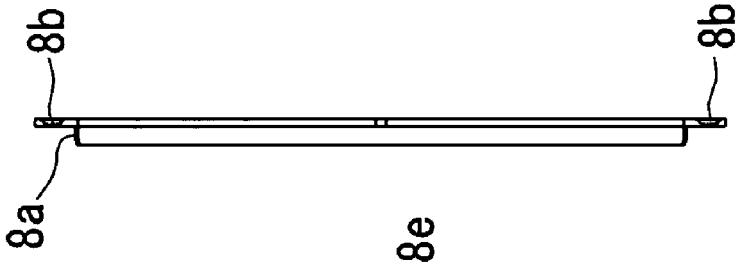
FIG. 9B is a front view of the second frame.
Figure 9A:
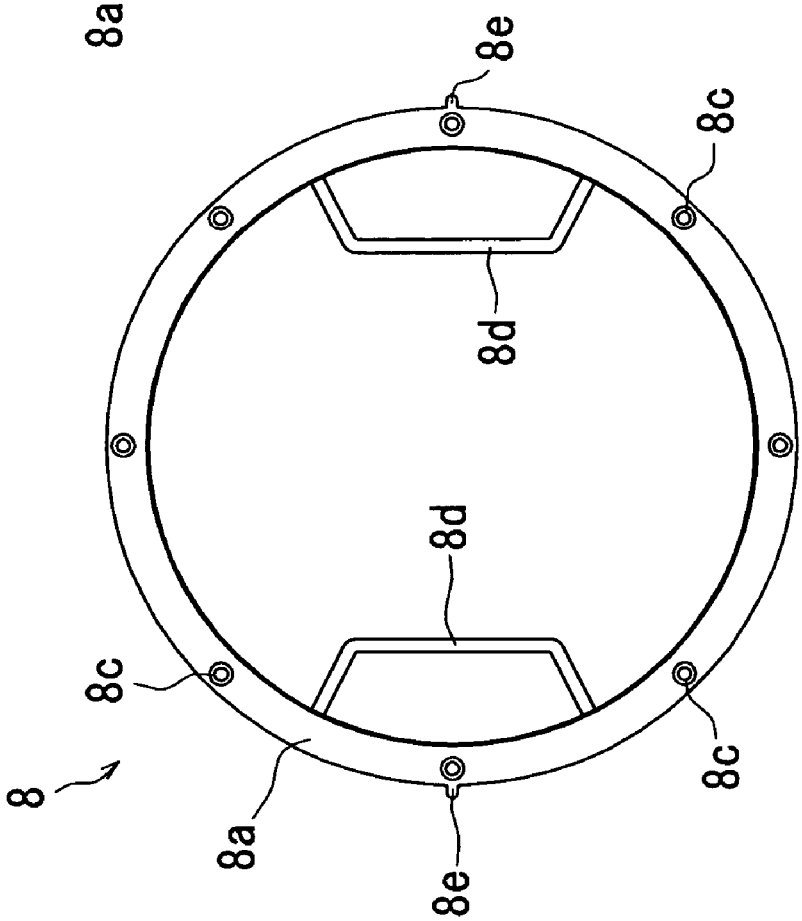
FIG. 9A is a left side view of the second frame.

As shown in FIGS. 5 and 8, the first frame 7 has a first ring plate 7*a* arranged in a radial direction and a ring plate 7*b* extended outward in the axial direction X from an inner end of the first ring plate 7*a*. The ring plate 7*b* has an inwardly warped end to protect the first net member 3 from damages. The ring projection 2*a* is fit in a ring-shaped cavity K1, which is defined by the ring recess 10*a* and the first frame 7 and has a ring-shaped opening P1. The ring plate 7*b* pressingly holds down the ring projection 2*a* inward in the radial direction to prevent the ring projection 2*a* from being slipped off the matching recess. The ring-shaped cavity K1 is designed to be greater in size than the ring projection 2*a*. The ring recess 10*a* is formed in an L shape with an upwardly (inwardly) extended free end but is not restricted to the illustrated structure. This is because an opening width of the ring-shaped opening P1 is designed to be smaller than the diameter of the ring projection 2*a*, and the ring projection 2*a* has a circular cross section along the axial direction and is made of the material having the sufficient hardness to hold the circular shape when being fit in the matching recess. The first frame 7 has multiple through holes 7*c* (counter bores) formed in the axial direction X. Four of the through holes 7*c* are used to fasten the rods 6 and receive the Phillips head screws 6*f* seated therein. The remaining through holes 7*c* receive Phillips head screws 20 (see FIG. 1) seated therein for reinforced linkage of the first frame 7 with the holder frame 11.

Figure 6:
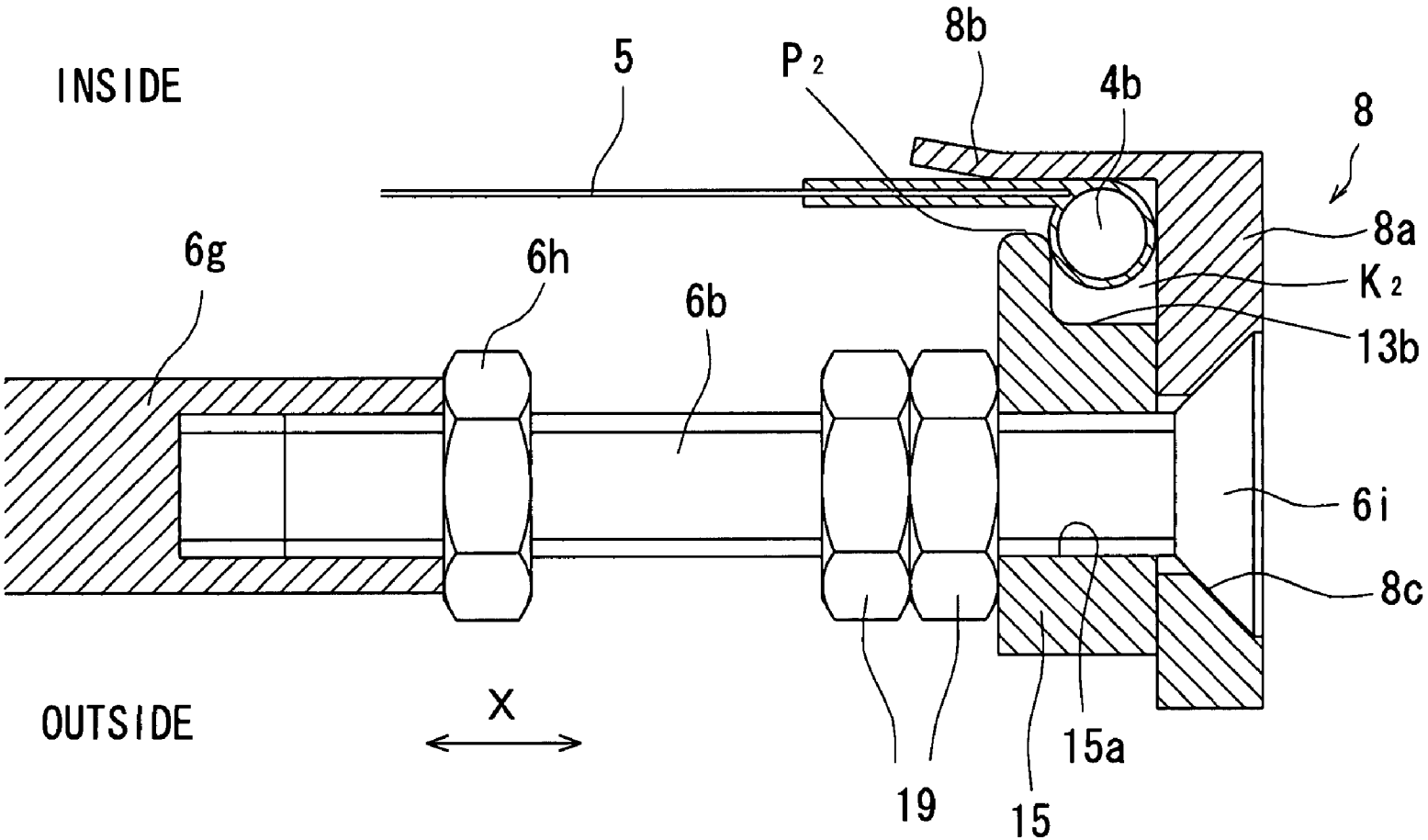
FIG. 6 is an end-vertical sectional front view showing a second frame of the cylindrical sieve.

As shown in FIGS. 6 and 9, the second frame 8 has a first ring plate 8*a* arranged in the radial direction and a ring plate 8*b* extended inward in the axial direction X from an inner end of the first ring plate 8*a*. The ring plate 8*b* has an inwardly warped end to protect the second net member 5 from damages. The ring projection 4*b* is fit in a ring-shaped cavity K2, which is defined by the ring recess 13*b* and the second frame 8 and has a ring-shaped opening P2. The ring plate 8*b* pressingly holds down the ring projection 4*b* outward in the radial direction to prevent the ring projection 4*b* from being slipped off the matching recess. This is because an opening width of the ring-shaped opening P2 is designed to be smaller than the diameter of the ring projection 4*b*, and the ring projection 4*b* has a circular cross section along the axial direction and is made of the material having the sufficient hardness to hold the circular shape when being fit in the matching recess. The second frame 8 has multiple (eight in this embodiment) through holes 8*c* (counter bores) formed in the axial direction X. Four of the multiple through holes 8*b* are used to fasten the rods 6 and receive the Phillips head screws 6*i* seated therein. The remaining through holes 8*c* receive the Phillips head screws 20, (see FIG. 1) seated therein for reinforced linkage of the second frame 8 with the holder frame 15. The second frame 8 also has inner handles 8*d* and outer guide projections 8*e* provided for easy attachment to the cylindrical sifter (not shown). The guide projections 8*e* are fit in grooves (not shown) formed in the cylindrical sifter (not shown). The cylindrical sieve 1 with the handles 8*d* held with the worker's hands is pressed into and is thereby fixed in the cylindrical sifter (not shown).

Figure 7:
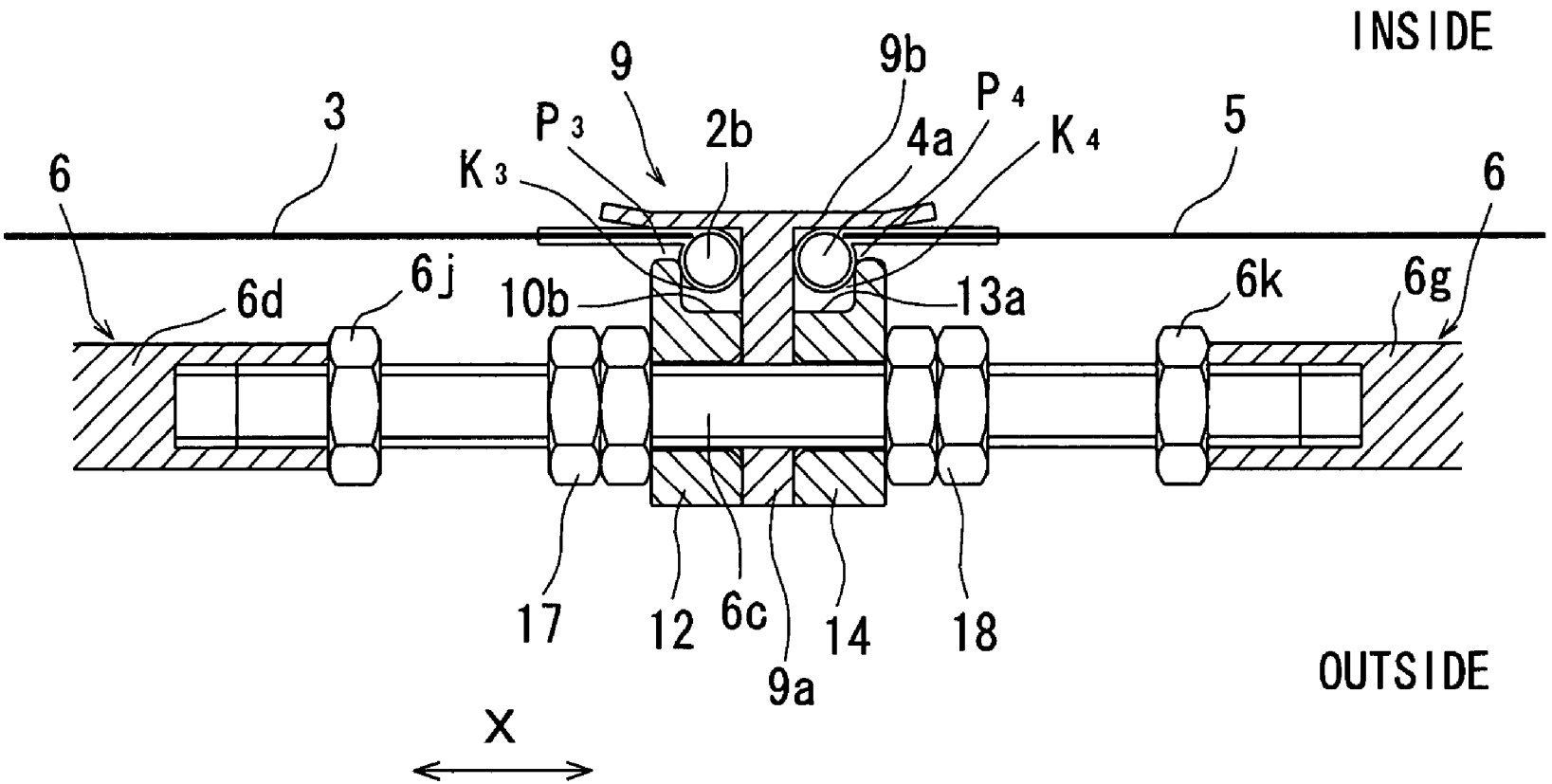
FIG. 7 is an end-vertical sectional front view showing the intermediate frame of the cylindrical sieve.
Figure 10C:
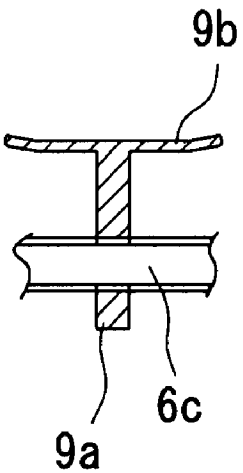
FIG. 10C is an end-sectional front view of the intermediate frame.
Figure 10B:
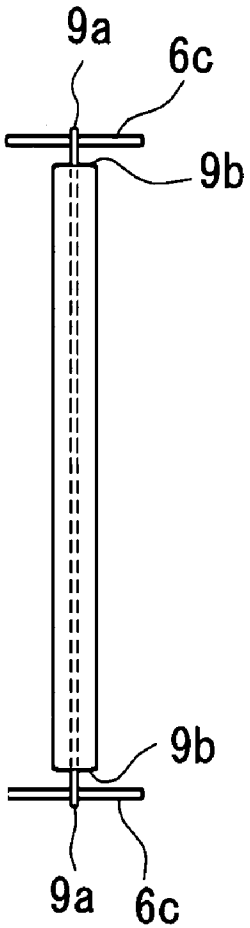
FIG. 10B is a front view of the intermediate frame.
Figure 10A:
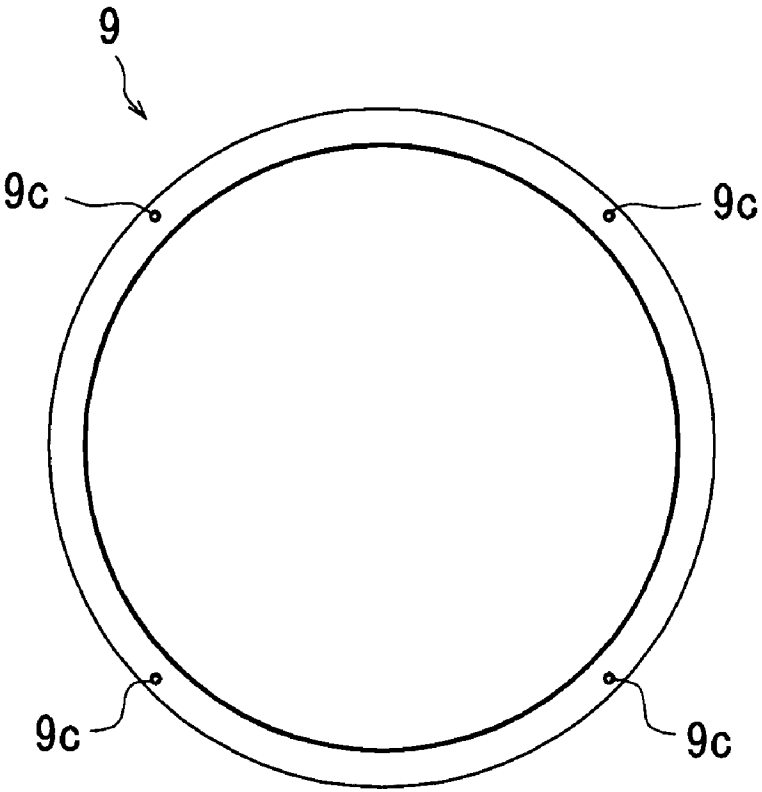
FIG. 10 is a left side view of the intermediate frame.

As shown in FIGS. 7 and 10, the intermediate frame 9 has a first ring plate 9*a* fixed (welded in this embodiment) to tapped center areas of the middle sections 6*c* of the respective rods 6 and arranged in the radial direction and a second ring plate 9*b* extended in the axial direction X on both sides of the first ring plate 9*a*. The ring projection 2*b* and the ring projection 4*a* are respectively fit in a ring-shaped cavity K3, which is defined by the ring recess 10*b*, the first ring plate 9*a*, and the second ring plate 9*b* and has a ring-shaped opening P3, and in a ring-shaped cavity K4, which is defined by the ring recess 13*a*, the first ring plate 9*a*, and the second ring plate 9*b* and has a ring-shaped opening P4. The second ring plate 9*a* pressingly holds down the ring projections 2*b* and 4*a* outward in the radial direction to prevent the ring projections 2*b* and 4*a* from being slipped off the matching recesses. This is because opening widths of the respective ring-shaped openings P3 and P4 are designed to be smaller than the diameters of the corresponding ring projections 2*b* and 4*a*, and the ring projections 2*b* and 4*a* have circular cross sections along the axial direction and are made of the material having the sufficient hardness to hold the circular shapes when being fit in the matching recesses. The intermediate frame 9 has multiple (four in this embodiment) through holes 9*c* formed in the axial direction X.

Figure 11C:
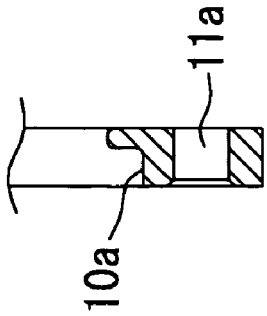
FIG. 11C is an end-sectional front view of the holder frame.
Figure 11B:
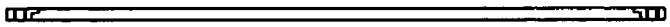
FIG. 11B is a front view of the holder frame.
Figure 11A:
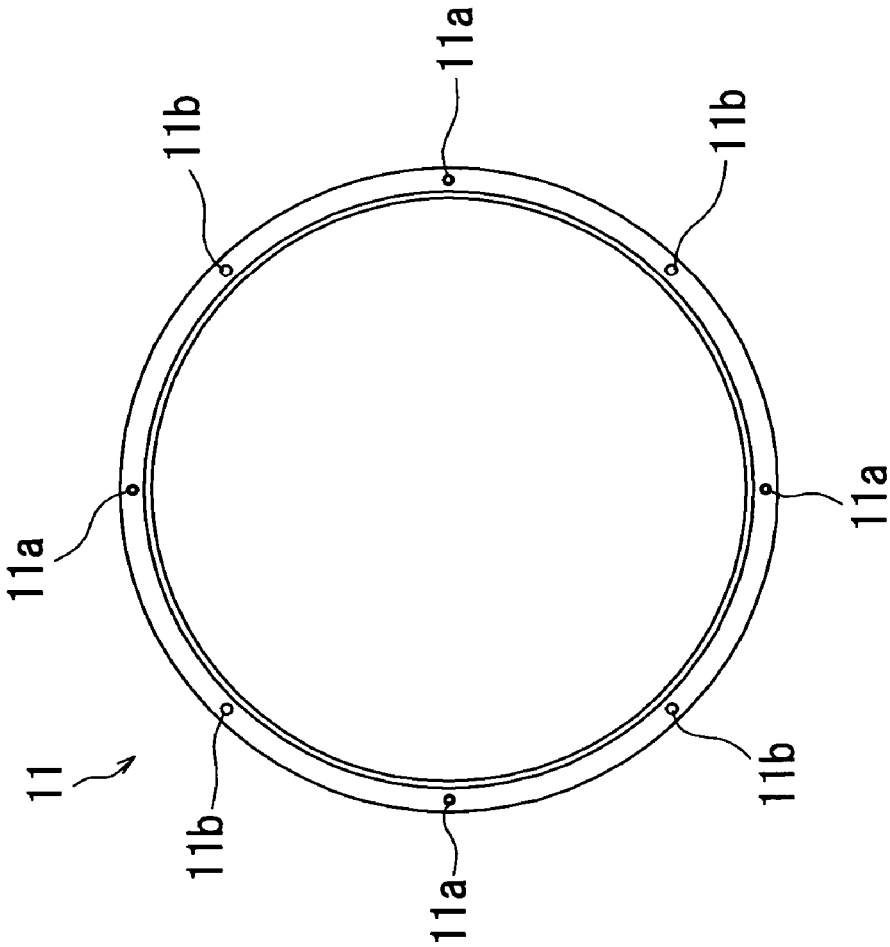
FIG. 11A is a left side view of a holder frame.

As shown in FIGS. 5 and 11, the first holder frame 11 has the ring recess 10*a* arranged outside in the axial direction X and multiple (four in this embodiment) through holes 11*a*. The respective one end sections 6*a* of the rods 6 run through these through holes 11*a* (see FIG. 5). The Phillips head screws 20 (see FIG. 1) are screwed into multiple (four in this embodiment) screw holes 11*b* of the first holder frame 11. The second holder frames 14 and 15 have similar structures with the ring recesses 10*a* and 10*b* arranged opposite to each other.

The second holder frames 14 and 15 have similar structures to those of the first holder frames 11 and 12. The above description and illustration regarding the first holder frame 11 is thus also applied to the second holder frames 14 and 15.

The fixation elements 16, 17, 18, and 19 are nuts to be screwed and set onto the male threads formed on the outer circumferences of the rods 6 to be relatively movable in the axial direction X. The fixation elements 16 to 19 function as stoppers of the holder frames 11, 12, 14, and 15. The loosened fixation elements 16 to 19 enable the holder frames 11, 12, 14, and 15 to freely move along the rods 6.

Figure 12A:
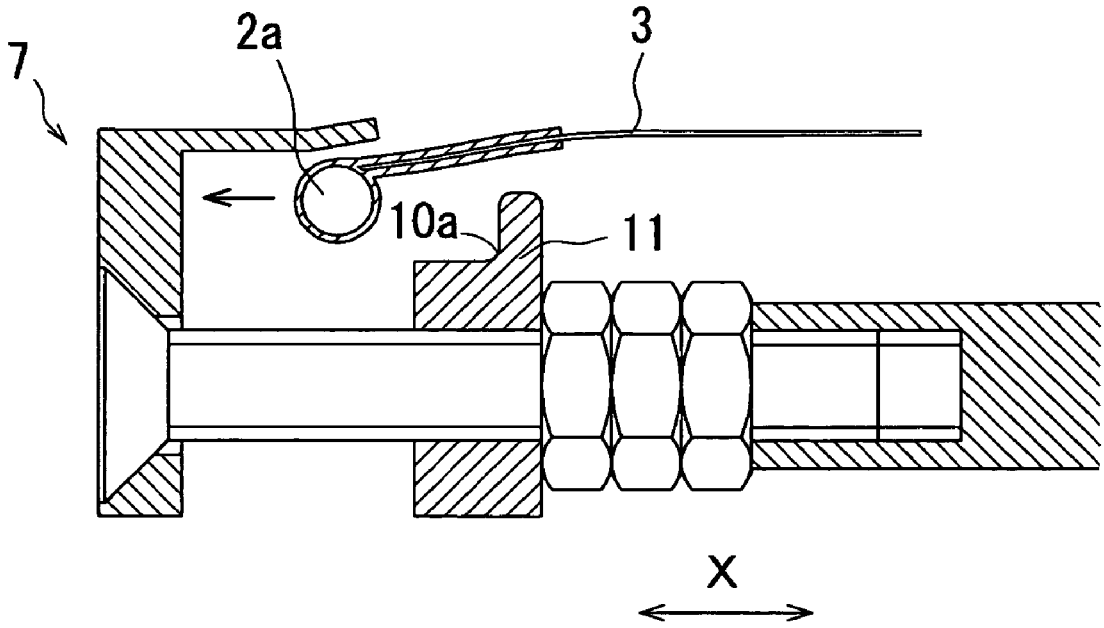
FIGS. 12A and 12B show assembly method of the cylindrical sieve.
Figure 12B:
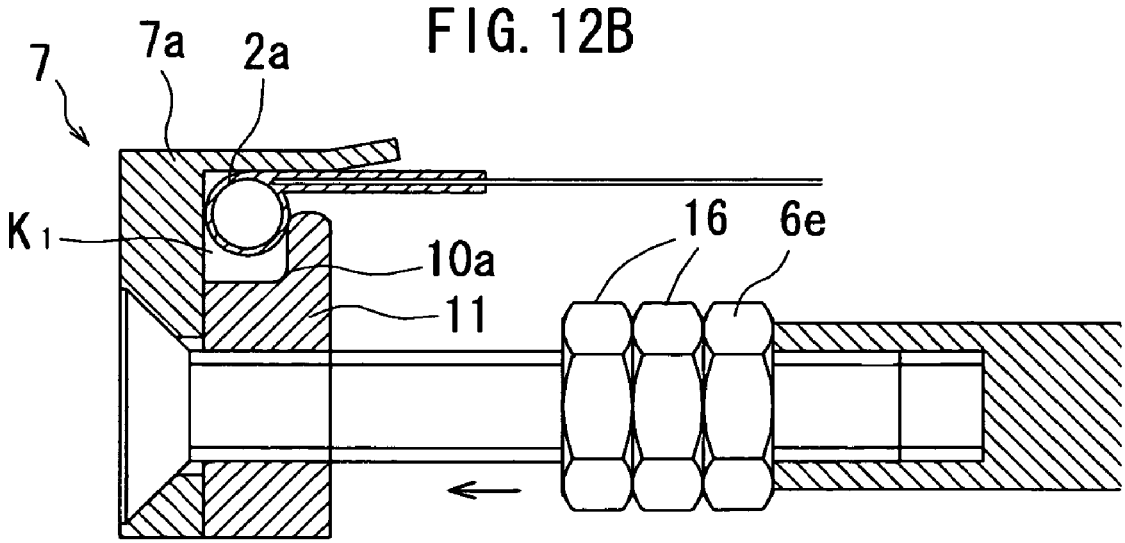

Assembly of the cylindrical sieve 1 of this embodiment is described with reference to FIG. 12. The assembly process first clamps the first net member 3 between the first frame 7 and the first holder frame 11. The ring projection 2*a* is inserted into an inner end area by taking advantage of the flexibility of the first net member 3 as shown in FIG. 12A. The holder frame 11 is slid leftward in the drawing to receive the ring projection 2*a* in the ring-shaped cavity K1, which is defined by the ring recess 10*a* and the inner end wall of the first frame 7. The holder frame 11 is fastened to the first frame 7 via the fixation elements 16. A left vertical plane of the holder frame 11 is brought into contact with a right vertical plane of the first frame 7, so that the ring projection 2*a* is closed and retained in the ring-shaped cavity K1. The linkage of the holder frame 11 with the first frame 7 effectively prevents the ring projection 2*a* from being slipped off the ring-shaped cavity K1. The ring projection 2*b* on the other end of the first net member 3 is received and retained in the ring-shaped cavity K2 in a similar manner, so the above description is also applied to this part.

The loosened fixation elements 16 enable the first net member 3 having the sufficient flexibility to be drawn out according to the reverse procedure for replacement. A new first net member 3 of the sufficient flexibility is inserted into the inner space of the framework of the cylindrical sieve 1 and is securely fastened according to the above procedure.

The second net member 5 is fastened and replaced in a similar manner to that of the first net member 3. The above description is thus also applied to the second net member 5.

As described above, the ring projections 2*a*, 2*b*, 4*a*, and 4*b* are clamped between the adjoining ring frames and are securely fastened. The holder frames 11, 12, 14, and 15 apply the overall fixation force to set the even tension onto the net members 3 and 5. The cylindrical sieve 1 manufactured in accurate dimensions enables even a non-skilled worker to strain the net members 3 and 5 with the even tension. The holder frame 11, 12, 14, and 15 uniformly press the net members 3 and 5 without any tension-affecting elements, such as screws and bands, so as to apply the even tension.

Figure 13:
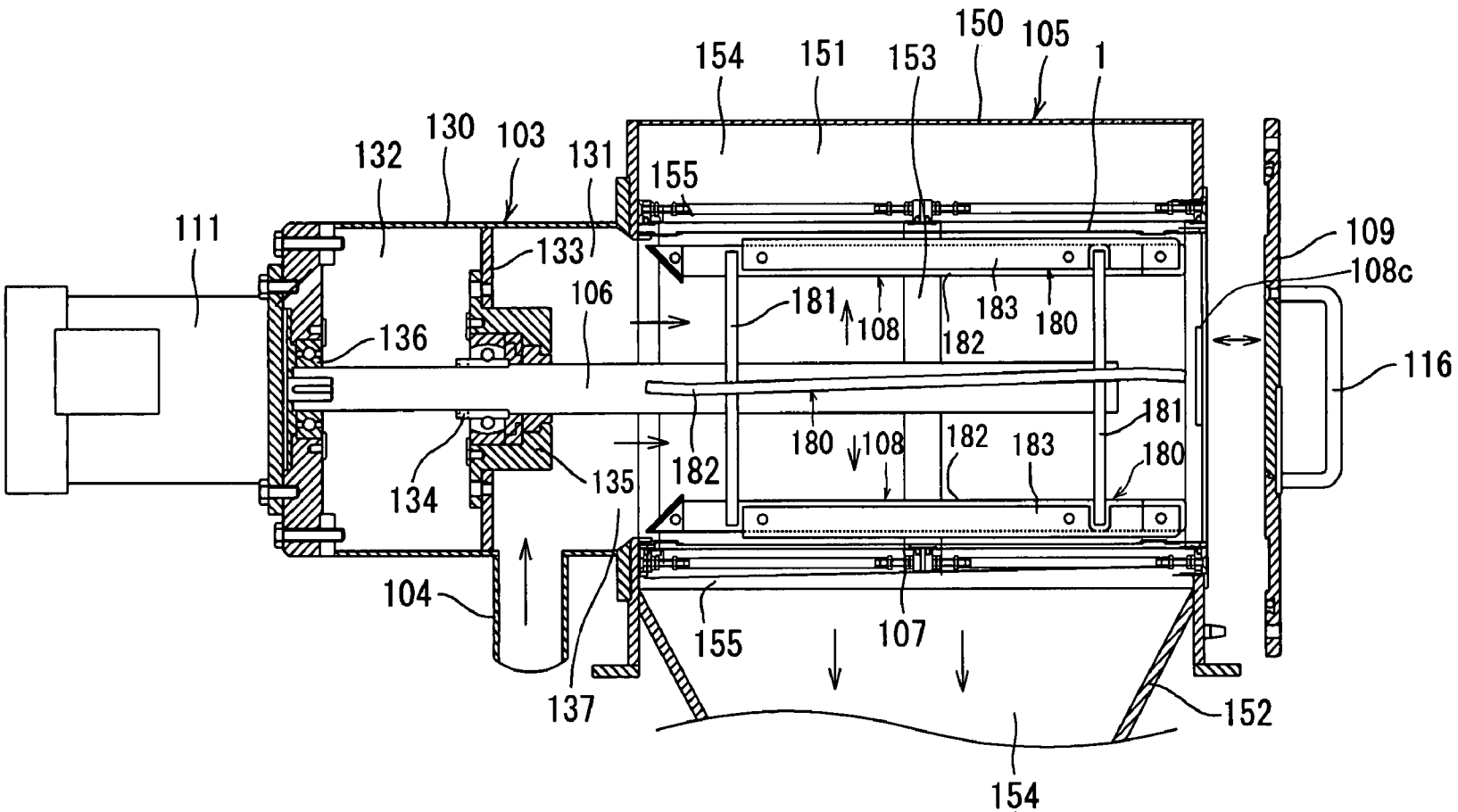
FIG. 13 is a center-vertical sectional view showing a cylindrical sifter with the cylindrical sieve attached thereto.

The cylindrical sieve of this embodiment is applicable to an inline sifter disclosed in WO 02/38290A1 as shown in FIG. 13.

An inline sifter 101 shown in FIG. 13 includes a particulate-air mixture receiver unit 103 that receives pneumatically conveyed particulate-air mixture, a particulate-air mixture inlet 104 of a circular tube that is connected with the particulate-air mixture receiver unit 103 and supplies the particulate-air mixture conveyed from an upstream line via an upstream blower and an upstream rotary valve (not shown) to the particulate-air mixture receiver unit 103, and a sifter module 105 that has an inner space horizontally communicating with the inner space of the particulate-air mixture receiver unit 103 fixed on one end thereof. The inline sifter 101 also includes a rotating shaft 106 that is extended horizontally in the particulate-air mixture receiver unit 103 and the sifter module 105, a tubular sieve 107 that is set in the sifter module 105, a booster 108 that is integrated with the rotating shaft 106 and is extended in a rotatable manner inside the sieve 107 to increase the air flow, an access door 109 that is provided in the sifter module 105 for removal of aggregates and lumps caught on the sieve 107 and for internal inspection, an outlet joint pipe 110 that is provided downstream the sifter module 105 and discharges the particulates passing through the sieve 107 to a downstream line, and a motor 111 that drives and rotates the rotating shaft 106.

The particulate-air mixture receiver unit 103 includes a cylindrical feed casing 130, a cylindrical feed chamber 131 that communicates with the particulate-air mixture inlet 104 that is connected to the outer circumference of the feed casing 130 in a tangentially inclined manner, a bearing chamber 132 that receives bearings therein, a partition wall 133 that separates the feed chamber 131 from the bearing chamber 132, and a shaft hole 134 that is formed in the partition wall 133 to receive the rotating shaft 106 therein. The particulate-air mixture receiver unit 103 also includes a first bearing 135 that is set in the shaft hole 134 to support the rotating shaft 106 in a rotatable manner, a second bearing 136 that is positioned on a left end portion of the particulate-air mixture receiver unit 103 and supports the rotating shaft 106 in a rotatable manner at a position closer to the shaft end than the first bearing 135, and a conduit 137 that feeds the particulate-air mixture into the sifter module 105. The first bearing 135 and the second bearing 136 are provided as cartridges, and the first bearing 135 has non-illustrated labyrinth ring and air purge. The position of the particulate-air mixture inlet 104 relative to the feed chamber 131 is preferably in the tangential direction of the outer wall of the feed casing 130 and has, for example, an inclination angle of 45 degrees. The position of the particulate-air mixture inlet 104 may be varied to have the inclination angle in a range of 0 to 90 degrees.

The sifter module 105 includes a shifter casing 150 that has an inverse U-shaped side view and a larger diameter than that of the particulate mixture receiver unit 103, a sifter process chamber 151 that is located inside the sifter casing 150 and communicates with the feed chamber 131, and a hopper-shaped particulate-air mixture outlet 152 that is provided below the sifter casing 150. The cylindrical sieve 1 of the embodiment is arranged coaxially in the sifter process chamber 151 to receive the rotating shaft 106 passing through the center thereof. An inner area 153 of the sieve 1 communicates with the feed chamber 131. The sifter process chamber 151 has a double cylindrical structure having the inner area 153 and an outer area 154 separated by the sieve 1. The outlet joint pipe 110 is connected to the lower end of the particulate-air mixture outlet 152.

The rotating shaft 106 has a cantilevered bearing structure with its free end extended to the vicinity of the right end of the sieve 1 inside the sifter process chamber 151.

The sieve 1 is designed to have an inner diameter substantially identical with the inner diameter of the feed casing 130 and a length approximately equal to the length of the sifter process chamber 151. The sieve 1 is detachably attached to the sifter casing 150 by means of a sieve fixation element 155.

The booster 108 is arranged outside the rotating shaft 106 and is extended in the inner area 153 of the sieve 1. The booster 108 has multiple (two in this example) radial elements 181 that are provided on both ends of the rotating shaft 106 in the area of the sieve 1, blades 182 that are fit in and fastened to the respective ends of the radial elements 181 and are extended to have a slight inclination (for example, in a range of 3 to 7 degrees and more specifically 5 degrees) relative to the axial direction of the rotating shaft 106, and plate scrapers 183 that are attached to at least part of the blades 182 and are a little projected outward in the radial direction from the blades 182 to make some clearances against the inner wall of the sieve 1 for scraping out the particulates from the inner area 153 to the outer area 154 via the sieve 1. The booster 108 has a pi (π) front shape and a cross-like side shape.

A preset number (four in this example) of the blades 182 are symmetrically arranged at specified angles in profile (90 degrees in this example). The blades 182 may be curved slightly on both ends thereof or may be straight. Each blade 182 has a long plate-like front shape.

The access door 109 is attached to and detached from a right side opening 13 of the sifter casing 150 by means of multiple mounting knobs 115. The access door 109 has two handles 116 set symmetrically against the center thereof and enables the sieve 1 to be removed through the side opening 113. Access windows 118 and 119 are formed on the center of the access door 109 and in the front section of the sifter casing 150 to enable the worker to visually check the inside of the sifter casing 150.

The motor 111 is driven to integrally rotate the rotating shaft 106 and the booster 108. A continuous supply of the particulate-air mixture through the particulate-air mixture inlet 104 in the tangential direction into the feed chamber 131 forcibly flows into the sifter process chamber 151 to reach the inner area 153 of the sieve 7.

The booster 108 is rotated at a high speed with rotation of the rotating shaft 106 inside the sieve 1, and the blades 182 and the radial elements 181 of the booster 108 accordingly stir the particulate-air mixture. Stirring of the particulate-air mixture with the blades 182 of the booster 108 effectively removes and crushes the lumps and aggregates of the particulates. The blades 182 also scratch off the lumped particulates accumulated on the nets of the sieve 1. The particulate-air mixture of the finer particulates than the mesh opening of the sieve 1 is accordingly fed to the outer area 154 and is flown into the downstream line via the outlet joint pipe 110, while the larger particulates and foreign substances than the mesh opening of the sieve 1 remain in the inner area 153.

The continuous operation of the inline sifter 101 naturally causes accumulation of the larger particulates and foreign substances in the inner area 153. The worker occasionally checks the inside of the inline sifter 101 through the access windows 118 and 119. When removal of the particulates and the foreign substances is required, the worker stops the operation of the inline sifter 101, loosens the mounting knobs 115 of the access door 109, and opens the access door 9 with the handles 116. The worker can thus gain access to the inside of the sifter process chamber 151 and remove the remaining particulates and foreign substances to clean the inside of the sieve 1 up. As for replacement of the sieve 1, the sieve 1 is detached from the sifter process chamber 151 and a new sieve is inserted into the same place. As for cleaning of the sieve 1, the sieve 1 is detached from the sifter process chamber 151 and is inserted into the same place after cleaning.

The cylindrical sieve 1 of the embodiment described above has the following advantages:

(1) The multiple rods 6 have the fixed length. The net members 3 and 5 are clamped between the adjoining frames 7, 8, 9, 11, 12, 14, and 15 by means of the ring projections 2*a*, 2*b*, 4*a*, and 4*b* provided on the respective ends of the net members 3 and 5. This structure enables even an unskilled worker to evenly apply the tension over the net members 3 and 5 and accordingly prevents any potential slack of the net members 3 and 5 due to a local difference (variation) in tension.

(2) The ring projections 2*a*, 2*b*, 4*a*, and 4*b* of the net members 3 and 5 are fastened by the frames 7, 8, 9, 11, 12, 14, and 15. This structure enables only one worker to easily replace even large net members.

(3) The simple structure of the embodiment separates the prior art sieves 3 and 21 into multiple pieces but still desirably lowers the total manufacturing cost of the net members 3 and 5.

(4) The ring projections 2*aa*, 2*b*, 4*a*, and 4*b* are not exposed to the outside. The multiple-frame structure has good appearance, as well as the high functionality.

Figure 14:
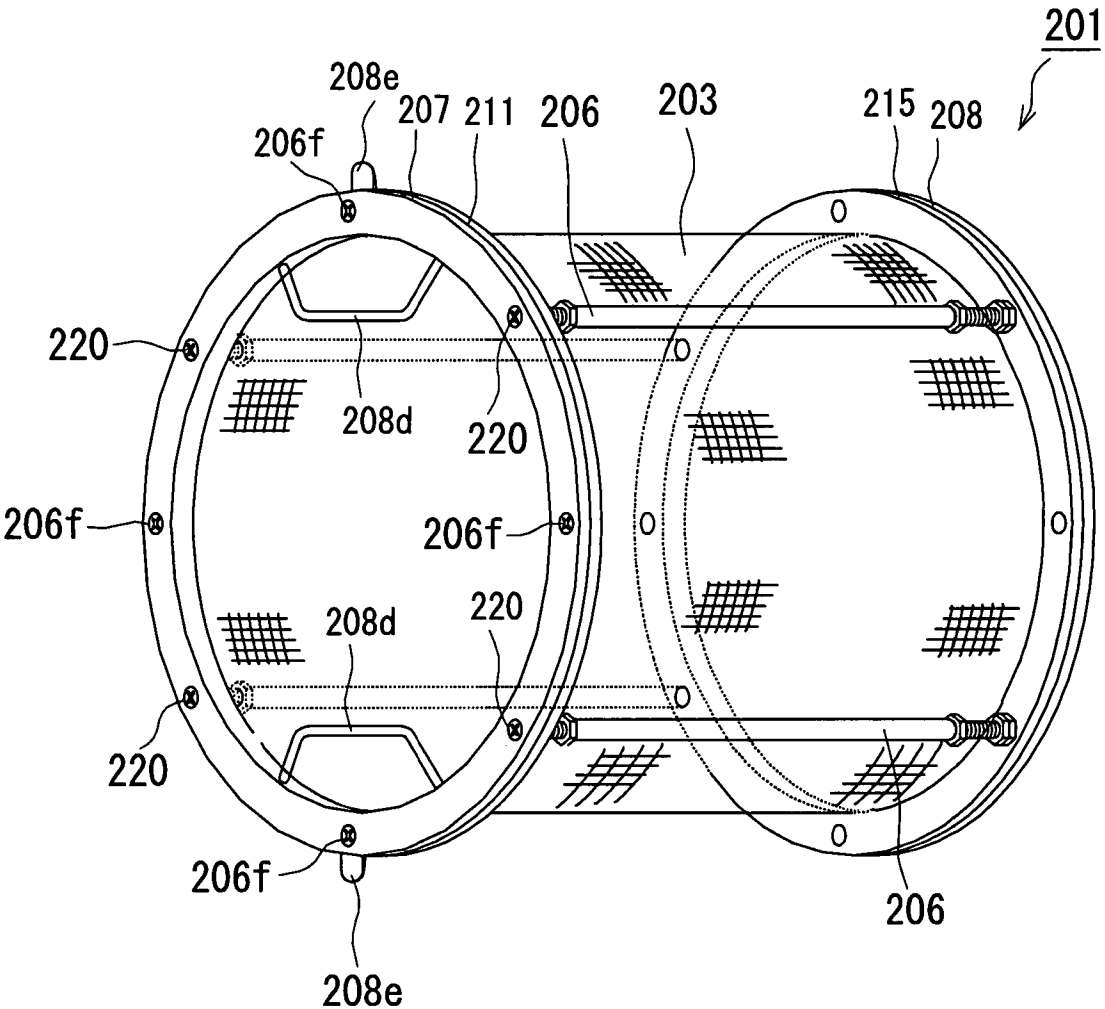
FIG. 14 is a perspective view showing another cylindrical sieve in a second embodiment of the invention.

In the structure of the first embodiment, the net members 3 and 5 are separated by the intermediate frame 9. The structure of a second embodiment shown in FIG. 14 has an integral net member 203, instead of the separate net members, and accordingly excludes the ring projection 2*b*, the ring projection 4*a*, the intermediate frame 9, the ring recess 10*b*, the first holder frame 12, the ring recess 13*a*, the second holder frame 14, the fixation elements 17 and 18, the nuts 6*e* and 6*h*, the middle sections 6*c*, the nuts 6*j* and 6*k*, the first ring plate 9*a*, the second ring plate 9*b*, the ring-shaped cavity K3, the ring-shaped cavity K4, and the through holes 9*c*. This structure is adoptable for a relatively short cylindrical sieve 201. The structure of the second embodiment exerts the similar effects to those of the first embodiment.

The embodiments discussed above are to be considered in all aspects as illustrative and not restrictive. There may be many modifications, changes, and alterations without departing from the scope or spirit of the main characteristics of the present invention. All changes within the meaning and range of equivalency of the claims are therefore intended to be embraced therein.

The structure of the above embodiment has only one intermediate frame 9, but multiple intermediate frames preferably having substantially identical diameter may be included in the sieve structure. The arrangement of the invention is applicable to cylindrical sifters of both a vertical structure and a horizontal structure. The Phillips head screws 6*f* and 6*i* used to fasten the rods 6 to the frames 7 and 8 are not restrictive at all and may be replaced by, for example, hexagon socket head bolts. The number of rods used in the sieve structure is not restricted to four but may be six or any other suitable number according to the diameter of the sieve structure. Assembly of the sieve structure and replacement of the net members may be executed with the sieve structure standing or lying.

What is claimed is:

1. A cylindrical sieve, which includes:

a cylindrical net member that has ring projections provided on both ends thereof;

multiple bar members of a preset length that are extended in an axial direction;

a first ring member that is provided with first lock elements fixed to or fit in respective one ends of said bar members;

a second ring member that is provided with second lock elements fixed to or fit in respective other ends of said bar members; and a pair of holder ring members that are located between said first ring member and said second ring member to be movable along said multiple bar members and have ring recesses, wherein said ring projections are set in said ring recesses, and said holder ring members are respectively brought into contact with said first ring member and with said second ring member, said first lock elements and said second lock elements work to prevent said ring projections from being slipped off said ring recesses, and said holder ring members are respectively fastened to said first ring member and to said second ring member by means of fixation elements.

2. A cylindrical sieve in accordance with claim 1, wherein each of said first ring member, said second ring member, and said intermediate ring member has a first ring plate arranged in a radial direction and a second ring plate extended in said axial direction from said first ring plate, and each of said ring projections is set in a ring-shaped cavity defined by said ring recess, said first ring plate, and said second ring plate, and said second ring plate holds down said ring projection inward in said radial direction and accordingly prevents said ring projection from being slipped off said ring-shaped cavity.

3. A cylindrical sieve in accordance with claim 1, wherein said fixation elements are nuts, which are screwed and set on male screws formed on said bar members to be relatively movable in said axial direction.

4. A cylindrical sieve in accordance with claim 1, wherein said ring projections have circular or rectangular cross sections in said axial direction and are made of a material having a sufficient hardness to hold their circular or rectangular shapes when being fit in said ring recesses.

5. A cylindrical sieve in accordance with claim 1, wherein said net member is surrounded by said multiple bar members, said first ring member, said second ring member, and said holder ring members.

6. A cylindrical sieve, which includes:

a cylindrical first net member that has ring projections provided on both ends thereof;

a cylindrical second net member that has ring projections provided on both ends thereof;

multiple bar members of a preset length that are extended in an axial direction;

a first ring member that is fixed to or fit in respective one ends of said bar members;

a second ring member that is fixed to or fit in respective other ends of said bar members;

an intermediate ring member that is fixed to middle sections of said bar members;

a pair of first holder ring members that are located between said first ring member and said intermediate ring member to be movable along said multiple bar members and have ring recesses; and a pair of second holder ring members that are located between said intermediate ring member and said second ring member to be movable along said multiple bar members and have ring recesses, wherein said ring projections of said first net member are set in said ring recesses of said first holder ring members, said first holder ring members are respectively brought into contact with said first ring member and with said intermediate ring member, and said first holder ring members are respectively fastened to said first ring member and to said intermediate ring member by means of fixation elements, and said ring projections of said second net member are set in said ring recesses of said second holder ring members, said second holder ring members are respectively brought into contact with said intermediate ring member and with said second ring member, and said second holder ring members are respectively fastened to said intermediate ring member and to said second ring member by means of fixation elements.

7. A cylindrical sieve in accordance with claim 6, wherein each of said first ring member, said second ring member, and said intermediate ring member has a first ring plate arranged in a radial direction and a second ring plate extended in said axial direction from said first ring plate, and each of said ring projections is set in a ring-shaped cavity defined by said ring recess, said first ring plate, and said second ring plate, and said second ring plate holds down said ring projection inward in said radial direction and accordingly prevents said ring projection from being slipped off said ring-shaped cavity.

8. A cylindrical sieve in accordance with claim 6, wherein said fixation elements are nuts, which are screwed and set on male screws formed on said bar members to be relatively movable in said axial direction.

9. A cylindrical sieve in accordance with claim 6, wherein said ring projections have circular or rectangular cross sections in said axial direction and are made of a material having a sufficient hardness to hold their circular or rectangular shapes when being fit in said ring recesses.

10. A cylindrical sieve in accordance with claim 6, wherein said net member is surrounded by said multiple bar members, said first ring member, said second ring member, and said holder ring members.

* * * * *